United States Patent [19]

Penird et al.

[11] Patent Number: 4,904,898

[45] Date of Patent: Feb. 27, 1990

[54] MONOCHROME CATHODE RAY TUBE ELECTRON GUN WITH HIGH VOLTAGE ELECTRODE LENS

[75] Inventors: Thomas W. Penird, Waterloo; Charles H. Rehkopf, Seneca Falls; Donald L. Say; Bruce W. Zellar, both of Waterloo, all of N.Y.

[73] Assignee: North American Philips Corporation, New York, N.Y.

[21] Appl. No.: 270,989

[22] Filed: Nov. 14, 1988

[51] Int. Cl.[4] ..... H01J 29/48; H01J 29/56

[52] U.S. Cl. ..... 313/449; 313/458

[58] Field of Search ..... 313/448, 451, 449, 458

[56] References Cited

U.S. PATENT DOCUMENTS 4,271,374 6/1981 Kimura ..... 313/449

4,634,924 1/1987 Hernqvist ..... 313/449 X 4,649,318 3/1987 Kikuchi et al. ..... 313/449

4,728,846 3/1988 Yasuda ..... 313/451

*Primary Examiner*—Palmer C. DeMeo

*Attorney, Agent, or Firm*—John C. Fox

[57] ABSTRACT

A monochrome cathode ray tube incorporates an electron gun featuring a focusing electrode having an upper cup-shaped portion comprising a top cylindrical sidewall portion and a lower inwardly tapering sidewall portion connecting to a flat bottom portion, the cup-shaped portion supported by an elongated cylindrical base portion having a diameter of from about 44 to 48 percent of the diameter of the upper cylindrical portion of the cup. The electron gun is particularly suitable for use in monochrome cathode ray tubes for projection color television.

4 Claims, 2 Drawing Sheets

MONOCHROME CATHODE RAY TUBE ELECTRON GUN WITH HIGH VOLTAGE ELECTRODE LENS

BACKGROUND OF THE INVENTION

This invention relates to a monochrome cathode ray tube, and more particularly relates to an electron gun for such tube having improved high voltage performance.

Monochrome cathode ray tubes, for example, for projection television, employ a single electron gun mounted in the neck of the tube to focus a single electron beam on the fluorescent display screen of the tube. A deflection yoke surrounding the neck of the tube and associated electronic circuitry causes the beam to scan the screen as well as to vary in intensity in response to a video signal to produce a monochrome display image.

In projection color TV, three such displays, each in one of the primary colors red, blue and green, are superimposed on a large projection screen to produce a full color display image. Because the images on the tube screens are not viewed directly, but are magnified and projected by a system of projection lenses, the individual cathode ray tubes are driven at higher voltages and beam currents than would be encountered for direct view tubes, in order to produce a full color display of acceptable brightness. This higher brightness must be achieved without significant degradation of image resolution. Thus, it is essential that the tubes' electron guns exhibit not only good high voltage performance but also satisfactory lens performance.

Good high voltage performance is defined herein as a high threshold of field emissions during tube operation. Such a high threshold can be achieved if, for example, the electron gun is susceptible to effective high voltage conditioning. High voltage conditioning is carried out as one of the final steps of the manufacturing process, and constitutes subjecting the electron gun to voltages in excess of those encountered during subsequent tube operation, in order to induce arcing between the components to eliminate particles, projections and other sources of stray emission.

The most critical part of such an electron gun structure for both high voltage performance and lensing performance is the high voltage gap between the final focusing and accelerating electrodes. In an electron gun design of the prior art, this gap is defined by partially overlapping focusing and accelerating electrodes, the focusing electrode comprising a cup-shaped top portion and an adjoining elongated cylindrical base portion having a diameter of about 56% of that of the cup-shaped portion. The accelerating electrode comprises a taller and wider cup-shaped top portion coaxially surrounding the cup-shaped portion of the focusing electrode, and a shorter and wider cylindrical base portion, coaxially surrounding the upper region of the cylindrical base portion of the focusing electrode.

While it has been found in practice that the lensing performance of such an electron gun is acceptable for the demanding application of projection television, nevertheless the high voltage performance is less than desired for such an application.

OBJECTS AND SUMMARY OF THE INVENTION

Accordingly, it is a principal object of the invention to improve the high voltage performance of an electron gun for a monochrome cathode ray tube without degrading its lensing performance.

It is another object of the invention to provide an electron gun for a monochrome cathode ray tube which can be effectively high voltage conditioned.

In accordance with the invention, it has been discovered that the high voltage performance of the monochrome cathode ray tube electron gun of the prior art can be significantly improved without significantly degrading the lensing performance of the gun, by modifying the shape of the focusing electrode in a manner to render the high voltage gap more susceptible to high voltage conditioning, thereby improving high voltage performance, without significantly degrading lensing performance.

In accordance with the invention, the sidewalls of the cup-shaped portion of the focusing electrode comprise a short cylindrical upper portion supported by a lower portion which tapers inwardly from the cylindrical portion. The tapered portion may, for example, be conical. As a result of this design, arcs induced during high voltage conditioning tend to be concentrated in the gap between the cylindrical upper portion of the focusing electrode and the immediately adjacent portion of the surrounding sidewall of the cup-shaped portion of the accelerating electrode.

According to a preferred embodiment of the invention, the cylindrical base portion has a diameter about 44 to 48% of the diameter of the cylindrical upper portion of the focus electrode.

According to another preferred embodiment of the invention, the accelerating electrode comprises a cup-shaped portion having a cylindrical sidewall portion, and a bottom portion tapering inwardly from the sidewall portion and terminating in an outwardly flared ring defining a central aperture in the bottom portion.

DESCRIPTION OF THE PREFERRED EMBODIMENTS

Figure 1:
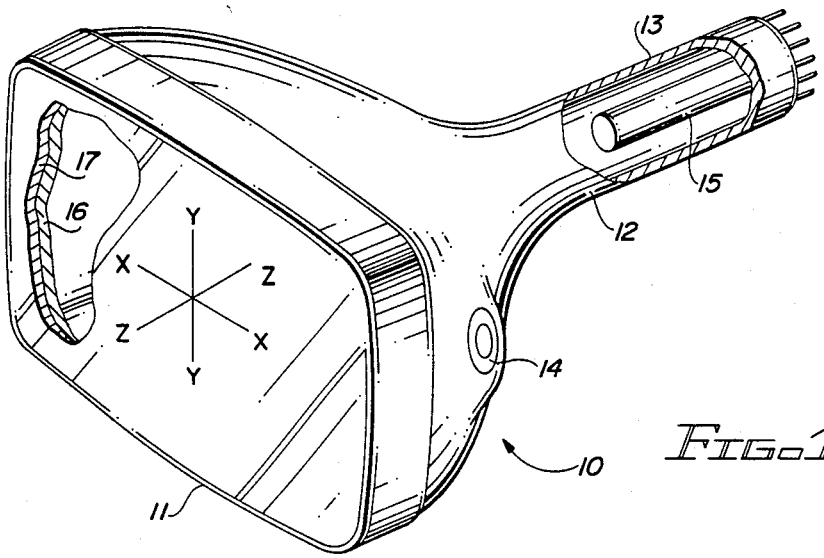
FIG. 1 is a perspective view, partly cut away, of a monochrome projection cathode ray tube.

Referring now to FIG. 1, there is shown a projection cathode ray tube 10 comprised of a glass face panel portion 11, frit sealed to a glass funnel portion 12. The funnel portion 12 includes a neck portion 13 and a metal anode button 14 sealed into the sidewall of the funnel. The tube is oriented three-dimensionally with respect to X, Y and Z axes as indicated on the face of the panel. Electron gun 15 is mounted in the neck portion 13 of the tube. The electron gun projects a beam of electrons onto a phosphor screen 16 disposed on the internal surface 17 of the display panel 11.

Figure 2:
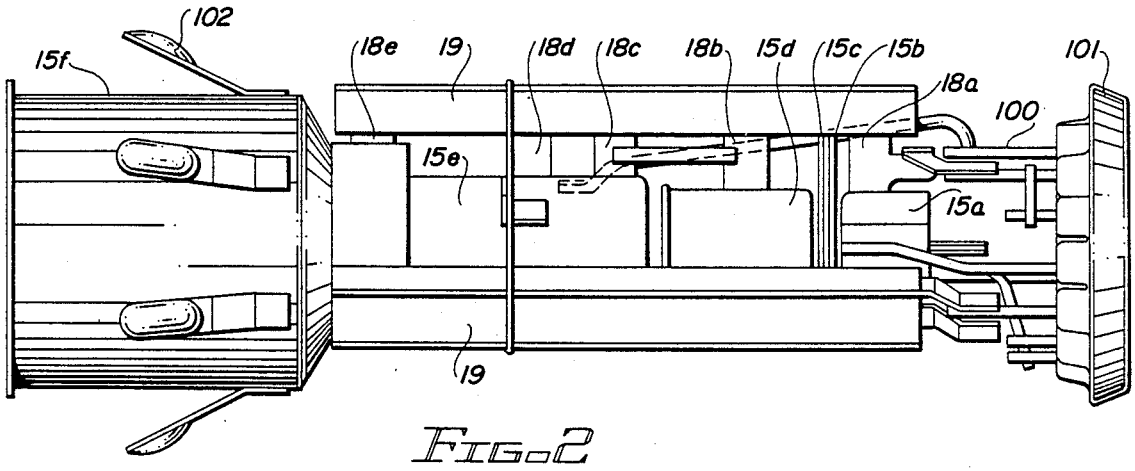
FIG. 2 is a front elevation view of a monochrome electron gun of the prior art.

FIG. 2 shows in detail the various elements of the electron gun 15, including thermionic cathode **15*a*, which is the electron source, grids 15*b* and 15*c*, which form the electrons into a beam, the focusing electrode, which is divided into a lower portion 15***d* and an upper portion 15*e*, partly obscured by accelerating electrode 15*f*. The upper portion 15*e* will be referred to herein as the final focusing electrode. These elements are held in coaxial alignment by studs 18*a* through 18*e*, embedded in glass multiforms 19. Operating voltages are applied to the elements 15*a* through 15*e* via leads 100, which pass through the base 101 of the neck to connector pins, not shown. Operating voltage to the accelerating electrode 15*f*, usually called anode voltage, is supplied via snubbers 102, which are connected to anode button 14 via an internal conductive coating, also not shown.

Figure 3:
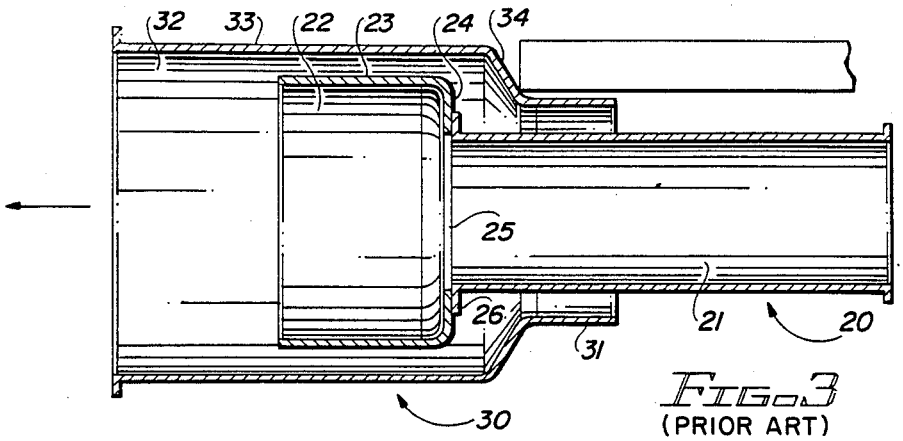
FIG. 3 (PRIOR ART)
FIG. 3 is a longitudinal sectional view showing the focusing and accelerating electrodes of the electron gun of FIG. 2.

The main lensing action of the electron gun on the electron beam occurs in the vicinity of the gap between the final focusing and accelerating electrodes of the gun. FIG. 3 is a section view of these two electrodes for an electron gun of the prior art. Final focusing electrode 20 comprises a lower cylindrical base portion 21, and an upper cup-shaped portion 22 having cylindrical sidewalls 23 and a flat bottom 24 defining a central aperture 25 for passage of the electron beam in the direction indicated by the arrow. The cup-shaped portion 22 is supported by annular flange 26 extending laterally from the top of base 21.

Concentrically surrounding the cup-shaped portion 22 and part of the base portion 21 of the final focusing electrode is an accelerating electrode 30, comprising a lower short cylindrical base portion 31, and an upper cup-shaped portion 32 comprising cylindrical sidewall 33, and tapered bottom 34, connecting sidewall 33 to base 31. Base 31 and sidewall 33 of cup-shaped portion 32 of the accelerating electrode have larger diameters than their counterparts in the final focusing electrode 20, and completely surround cup-shaped portion 22 of the focusing electrode 20.

As may be seen from FIG. 3, there is a relatively large surface area comprising the high voltage gap between these two electrodes. In accordance with the invention, it has been found that a large portion of this surface area is not related to lens performance. Moreover, this large surface area makes it more difficult to process the high voltage gap and thus greatly increases the probability of a particle or projection becoming a field emitting site.

Figure 4:
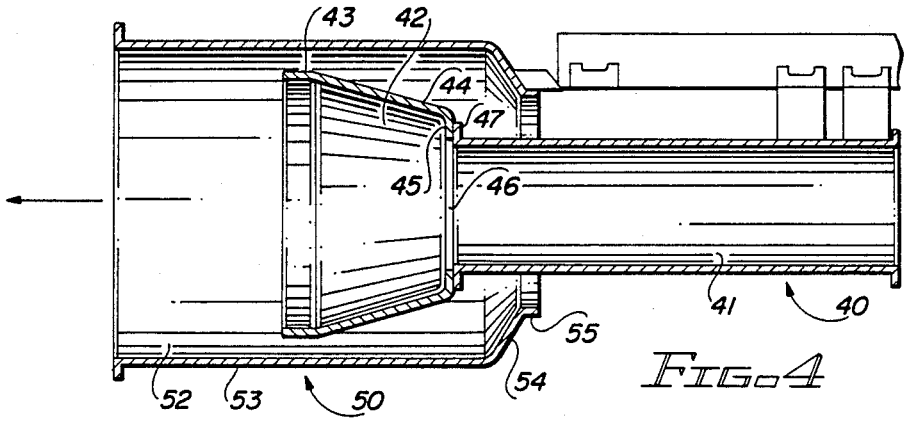
FIG. 4 is a view similar to that of FIG. 3 for one embodiment of the electron gun of the invention.

Referring now to FIG. 4, there is shown a cross-section of the final focusing and accelerating electrodes, 40 and 50 respectively, of an electron gun of the invention, in which the surface area between these two electrodes has been considerably reduced. As may be seen in the figure, this surface area reduction has been accomplished by providing cup-shaped portion 42 with an upper short cylindrical section 43 and tapered sidewalls 44, which join section 43 to flat bottom 45, defining central aperture 46. This cup-shaped portion 42 is supported on annular flange 47 extending laterally from the top of cylindrical base 41. This cup-shaped portion is completely surrounded by the cup-shaped portion 52 of the accelerating electrode comprising cylindrical sidewall 53, joined to tapered bottom 54, and terminating in an outwardly flared collar or corona ring 55. In addition, the diameter of cylindrical base portion 41 of the focusing electrode 40 has been reduced to about 46 percent of the diameter of the section 43. The accelerating electrode mounting studs which were attached to the cylindrical base portion in the prior art gun, have been moved up to the tapered bottom portion of the electrode. These modifications to the prior art design have been shown to result in significantly improved high voltage performance as evidenced by increased threshold of field emissions after high voltage processing, without a significant degradation of lensing performance.

In order to evaluate high voltage performance, two sets of projection tubes were built, a control set containing electron guns of the prior art and a test set containing electron guns of the invention, both sets of guns similar to those described above. Critical dimensions of the final focusing and accelerating electrodes of the two sets of electron guns are as follows: the focusing electrode base (designated G3B) diameter was 9 mm for the control and 7.55 mm for the test. The focusing electrode cup (designated G3C) sidewall height was 10 mm for both the control and test guns, but the entire sidewall of the control was cylindrical while only the upper 2 mm of the test cup were cylindrical. The remaining 8 mm tapered inwardly from the top in an inverted conical shape. The accelerating electrode (designated G4) of the test set was modified by eliminating the lower cylindrical base portion and rolling out the edge of the tapered bottom portion of the cup to form a flared collar or corona ring. The G4 mounting studs were located on the base in the control guns, and on the tapered part of the cup in the test guns. Also, the mounting studs of the cylindrical base portion 41 of the focusing electrode 40 were moved 1 mm away from the studs of the accelerating electrode 50, resulting in a combined 2 mm increase in the space between these studs and the adjacent G3 studs, from 9 mm to 11 mm. The lower gun elements were identical for both the control and test guns.

Both sets of tubes were subjected to a standard high voltage processing in which the focusing electrode and lower gun elements were subjected to an A.C. signal of damped oscillation pulses having a frequency of abut 1 kilohertz, a peak voltage of about 30 kilovolts and a fast rise time (about 3 microseconds). The accelerating electrode was subjected to five different anode voltages, progressively increased from 34 to 50 kilovolts. The effectiveness of this high voltage processing was determined by observing the number of arcs or discharges occurring during processing at various locations including the lensing area, that is, the region in the vicinity of the top of the G3 cup, the area below this lensing area, the area between the G3 and G4 mounting studs, and the area between the electrodes and the neck of the cathode ray tube. The results are reported in Table I below for two lots each of control and test tubes.

TABLE I

| LOT NO. | PROCESS STEP | ANODE VOLTAGE (KV) | LENS AREA G3/G4 | LOWER AREA G3/G4 | G3/G4 STUD DISCHARGE | NECK DISCHARGE |
|---|---|---|---|---|---|---|
| #1 Control | | | | | | |
| | 1 | 34 | 2 | 2 | 0 | 7 |
| | 2 | 40 | 5 | 3 | 0 | 1 |
| | 3 | 44 | 3 | 0 | 0 | 0 |
| | 4 | 48 | 5 | 2 | 5 | 1 |

TABLE I-continued

| LOT NO. | PROCESS STEP | ANODE VOLTAGE (KV) | LENS AREA G3/G4 | LOWER AREA G3/G4 | G3/G4 STUD DISCHARGE | NECK DISCHARGE |
|---|---|---|---|---|---|---|
| | 5 | 50 | 5 | 2 | 7 | 2 |
| #2 Control | | | | | | |
| | 1 | 34 | 4 | 3 | 2 | 2 |
| | 2 | 40 | 5 | 2 | 2 | 0 |
| | 3 | 44 | 3 | 5 | 1 | 0 |
| | 4 | 48 | 2 | 4 | 1 | 0 |
| | 5 | 50 | 1 | 10 | 3 | 0 |
| AVERAGE | | | 3.5 | 3.3 | 2.1 | 1.3 |
| #1 Test | | | | | | |
| | 1 | 34 | 10 | 0 | 0 | 0 |
| | 2 | 40 | 10 | 0 | 0 | 0 |
| | 3 | 44 | 10 | 0 | 0 | 3 |
| | 4 | 48 | 10 | 0 | 0 | 2 |
| | 5 | 50 | 10 | 0 | 0 | 2 |
| #2 Test | | | | | | |
| | 1 | 34 | 10 | 0 | 0 | 0 |
| | 2 | 40 | 9 | 0 | 0 | 1 |
| | 3 | 44 | 9 | 0 | 0 | 0 |
| | 4 | 48 | 9 | 0 | 0 | 0 |
| | 5 | 50 | 6 | 0 | 0 | 0 |
| AVERAGE | | | 9.3 | 0 | 0 | 0.8 |

In order for effective high voltage conditioning to occur, the arcing or discharging should occur predominantly in the high voltage lensing area between the G3 and G4 electrodes. Table I amply demonstrates that the number of arcs occurring in this lensing area is greater by a factor of almost three for the test sets than for the control set. In addition, spurious arcing in other regions such as the lower G3/G4 area, the studs and the neck, is significant for the control set, but is negligible for the test set.

In order to evaluate the effect of this arcing during processing on high voltage performance, the threshold for 1 microamp of field emission from the G3 was measured, and the thresholds for stray emission as well as neck glow, both indicated by blue fluorescence, were observed for the test and control sets, both prior to and after high voltage processing. The results are shown below in Table II, as the increase in thresholds after high voltage processing.

TABLE II

| | FIELD EMISSION (KV) (1 MICROAMP/G3) | VISIBLE STRAY (KV) AT FACEPLATE | NECK GLOW (KV) |
|---|---|---|---|
| #1 Test | 28 | 9 | 10 |
| #2 Test | 19 | 18 | 15 |
| AVERAGE | 23.5 | 13.5 | 12.5 |
| #1 Control | 18 | 7 | 15 |
| #1 Control | 17 | 20 | 4 |
| AVERAGE | 17.5 | 13.5 | 9.5 |

As may be seen from the Table, the results show significantly greater increases in threshold for field emission and neck glow, and a comparable increase for visible stray emission, for the test as compared to the control.

In order to evaluate the lensing performance of the electron gun of the invention compared to the electron gun of the prior art, equivalent lens diameter (ELD) was determined for each gun by electron optics modeling using a computer program. For this computer modeling, the same size dimensions were specified as were used for the high voltage performance tests, and the cathode and accelerating electrode (anode) voltages were specified to be 160 volts and 30 kilovolts, respectively. The specified cathode current value was varied step-wise from 4 down to 0.1 milliamps, and for each cathode current value the optimum focus voltage (that which resulted in the smallest spot size of the electron beam) was calculated for each gun. Results are reported in Table III below, in which the optimum spot size in millimeters and the optimum focus voltage in volts are given for each cathode current level. In addition, the average focus electrode voltage for each gun and the difference in average focus voltage between the two guns is given, expressed as ΔVfoc. From previous electron gun studies, it was known that the actual optimum focus voltage for the prior art gun is 18 percent of the anode voltage, which in this case is 5400 volts, 520 volts higher than the average voltage determined by the computer modeling program. In order to arrive at the average focus voltage for the gun of the invention then, the difference between the average focus voltage of the prior art gun and the gun of the invention, 170 volts, was added to 5400 volts. This resulted in a focus voltage of 5570, which is 18.6 percent of the anode voltage, reported in the Table as %Vfoc.

TABLE II

| | CONTROL | | TEST | |
|---|---|---|---|---|
| Ik (mA) | Spot (mm) | Focus (V) | Spot (mm) | Focus (V) |
| 4.0 | 0.55 | 4900 | 0.53 | 5100 |
| 2.0 | 0.5 | 4850 | 0.49 | 5000 |
| 1.0 | 0.43 | 4750 | 0.42 | 4950 |
| 0.5 | 0.34 | 4650 | 0.34 | 4750 |
| 0.1 | 0.39 | 5250 | 0.4 | 5450 |
| AVERAGE Vfoc (V) | | 4880 | | 5050 |
| ΔVfoc (V) | | — | | 170 |
| % Vfoc | | 18.0 | | 18.6 |
| ELD (mm) | | 20.5 | | 19.9 |
| % Loss in ELD | | — | | 2.9 |

Figure 5:
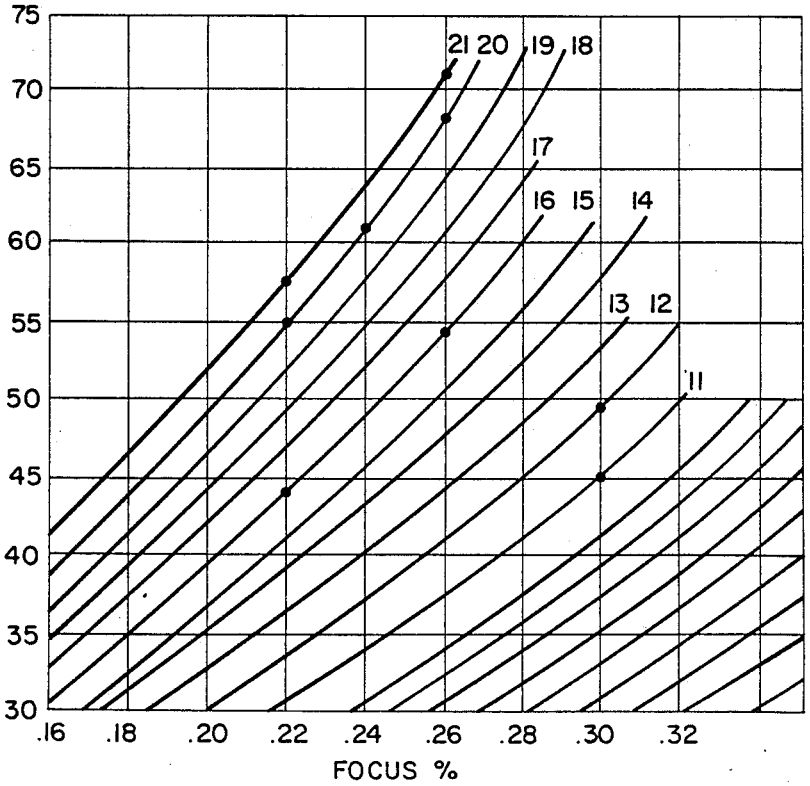
FIG. 5 is a graph of focusing electrode length vs. focus voltage as a percent of anode voltage, and related equivalent lens diameters (ELD).

Equivalent lens diameter (ELD) was then determined using the graph shown in FIG. 5, which is a grid pattern formed by extending with dotted lines values along the x and y axes of focus voltage as a percent of anode voltage and focusing electrode length (including the lower portion (e.g., 15*d* in FIG. 2) as well as the upper G3B/G3C portion) in millimeters, respectively. Overlying the grid pattern are a series of curves each representing a constant value of equivalent lens diameter (ELD) in millimeters. ELD was determined for each electron gun by first locating the intersection of the %Vfoc value and the focusing electrode length, and then noting upon which ELD curve the intersecting point fell. If the point fell between two curves, the ELD value was interpolated as a value between those of the two adjacent curves.

For both electron guns being evaluated, the focusing electrode length was 50 millimeters. The %Vfoc for the prior art gun was 18, resulting in an ELD of 20.5. The %Vfoc of the gun of the invention was 18.6, resulting in an ELD of about 19.9, which is 2.9% less than that of the electron gun of the prior art. These values are reported at the bottom of Table III, and indicate a loss in ELD which is considered to be tolerable, particularly in light of the accompanying significant improvement in high voltage performance.

What is claimed is:

1. A monochrome cathode ray tube comprising an evacuated glass envelope comprising a faceplate portion and a funnel-shaped portion including a neck portion, a fluorescent display screen disposed on the inner surface of the faceplate, and an electron gun disposed in the neck, the electron gun comprising a cathode and a series of electrodes terminating with a final focusing electrode and an accelerating electrode, the focusing and accelerating electrodes together forming a high voltage lensing field for an electron beam, the final focusing electrode comprising a lower elongated cylindrical base portion and an upper cup-shaped portion, and the accelerating electrode comprising a larger cup-shaped portion substantially surrounding the cup-shaped portion of the focusing electrode, characterized in that the focusing electrode cup-shaped portion comprises a short cylindrical upper sidewall portion supported by a lower sidewall portion, the lower sidewall portion inwardly tapering from the upper cylindrical sidewall portion, and in that the short cylindrical upper sidewall portion is nearer the accelerating electrode than the remaining portions of the focussing electrode.

2. The tube of claim 1 in which the accelerating electrode cup-shaped portion comprises a cylindrical sidewall portion and a bottom portion.

3. The tube of claim 2 in which the bottom portion tapers inwardly from the sidewall portion and terminates in an outwardly flared ring defining a central aperture.

4. The tube of claim 1 in which the diameter of the base portion of the focusing electrode is about 44 to 48 percent of the diameter of the upper cylindrical sidewall portion.

* * * * *